United States Patent [19]

Ollé

[11] 4,252,478

[45] Feb. 24, 1981

[54] SILOS FOR STORING GRANULAR MATERIAL

[75] Inventor: Jean L. Ollé, Pourrain, France

[73] Assignee: Société Stolz, Paris, France

[21] Appl. No.: 3,634

[22] Filed: Jan. 15, 1979

[30] Foreign Application Priority Data

Jan. 13, 1978 [FR] France ..... 78 00902

[51] Int. Cl.[3] ..... B65G 53/22; B65G 53/38

[52] U.S. Cl. ..... 406/90

[58] Field of Search ..... 406/86, 88, 89, 90, 406/91

[56] References Cited

U.S. PATENT DOCUMENTS 3,976,232 8/1976 Heidebroek ..... 406/91

FOREIGN PATENT DOCUMENTS 669640 9/1963 Canada ..... 406/91

1237374 6/1971 United Kingdom ..... 406/90

503801 4/1976 U.S.S.R. ..... 406/91

*Primary Examiner*—James L. Rowland

*Attorney, Agent, or Firm*—Karl F. Ross

[57] ABSTRACT

A silo for storing granular material, comprises substantially vertical side walls, and a peripheral trough in the lower portion of the silo. A static structure, such as a downwardly and outwardly inclined guide surface, is provided in the lower portion of the silo to guide material towards the trough. A pneumatic conveying system acts to convey the material along the trough towards a discharge opening therein.

12 Claims, 16 Drawing Figures

SILOS FOR STORING GRANULAR MATERIAL

BACKGROUND OF THE INVENTION

1. Field of the Invention

The present invention relates to silos for storing granular material, such as bulk products or cereals, for example.

2. Description of the Prior Art

Silos have been proposed with a suspended head, which although rendering it possible to avoid the need for a mechanical means for complete emptying by gravity, has the disadvantage of a substantial less useful volume in view of the presence of the head. A diameter of ten meters is rarely exceeded with a suspended head for cylindrical silos, and of 4 to 5 meters for rectangular silos.

This is the reason why preference is given to a silo design having a flat base joined to a substantially vertical side surface. A design of this nature allows a considerable gain of useful storage space, but requires mechanical emptying means, which becomes of greater size the greater cross-section of the silo.

It has been proposed to suspend an endless screw of the single or double acting type, by means of a pulley block connected to the roof of the silo, whereby the screw can be lowered onto the flat base of the silo to convey the material towards the discharge openings: this is the so-called "through-scraper" system. A system of this kind is, however, bulky, requires modifications to the roof of the silo and renders it possible to cope with no more than one silo at a time.

A system for use with a group of silos has been proposed and which for each silo comprises a diametral or lateral tunnel joined at right angles and at either side by ventilation ducts comprising "flaps" for guiding air flows. The granular material is thus fluidized close to the base and channelled between two adjacent ducts and against the walls of the ducts towards the tunnel until it is discharged below the tunnel by means of a mechanical conveyor. This system is, however, also bulky. In the case of cylindrical silos having diameters of ten meters, provision must be made to install on the base a very sizable tunnel joined at either side of the said tunnel by 9 ducts which requires approximately 72 meters of ducting and 36 ports leading to a central conveyor. Consequently, if a greater silo cross-section is contemplated, the ventilation equipment reaches a prohibitive cost because the pressure losses become substantial.

Each of these systems has the substantial disadvantage of leaving residual material behind in the silo which requires cleaning and sweeping out when different materials are to be subsequently stored in the silo.

SUMMARY OF THE INVENTION

According to the present invention, there is provided a silo for storing granular material, comprising a substantially vertical side wall, a base, means defining a peripheral trough in the lower portion of the silo, said trough having a base, static means in the lower portion of the silo for guiding material towards the trough, means defining at least one discharge opening in the base of the trough, and pneumatic conveying means for conveying the material towards the discharge opening.

BRIEF DESCRIPTION OF THE DRAWING

Embodiments of the invention will now be described, by way of example only, with reference to the accompanying diagrammatic drawing, in which.

SPECIFIC DESCRIPTION

Figure 1:
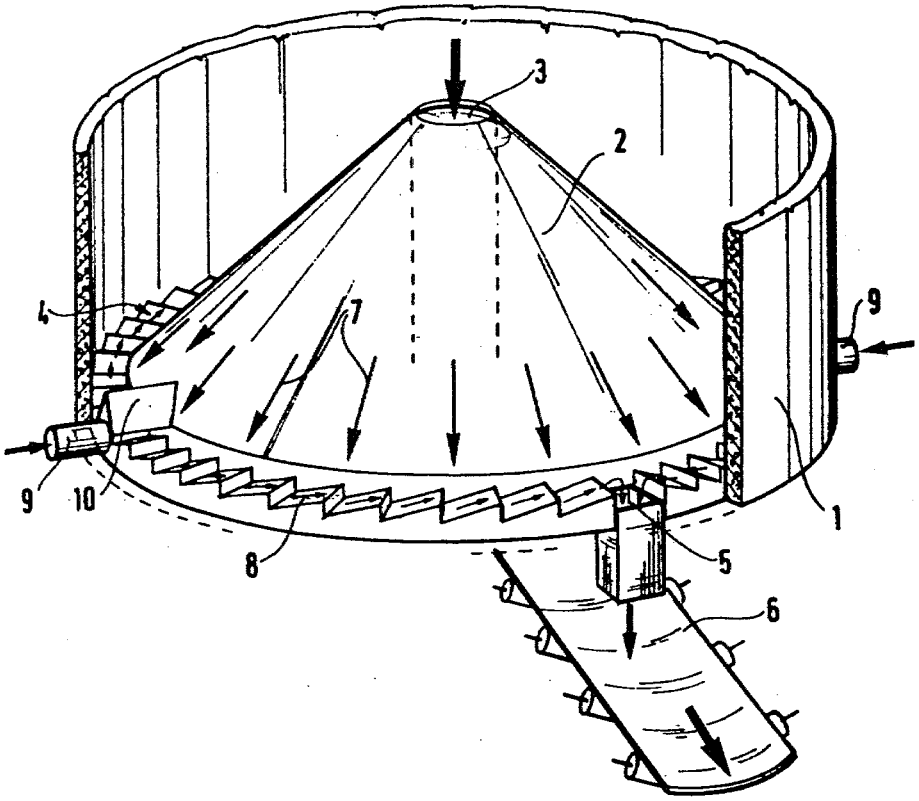
FIG. 1 is a fragmentary perspective view of a silo in accordance with the invention.

FIG. 1 shows the lower portion of a cylindrical silo, of which the wall 1, which is of concrete in this case, has been cut-away partially for a clearer view of the base of the silo.

In the silo the granular material is guided by static means towards a peripheral trough and then the material is conveyed along the periphery of the base by pneumatic means towards at least one discharge opening formed in the base of the trough. The static means consists of a surface which is concave downwards and is joined to the peripheral trough, this surface and the trough forming the base of the said silo element.

The design thus differs from the previous designs since the base of the silo simultaneously plays a part in the guiding and peripheral conveying of the granular material as will be described hereinafter.

More particularly, the guiding surface is an inverted cone 2 (for example of polished metal) the apex of which has a central discharge opening 3 and the lower edge of which is joined to a peripheral trough 4 comprising at least one discharge opening 5 connected to a bottom conveyor 6 known per se. The material is guided (arrows 7) by the inclined surface towards the peripheral trough 4 where a conveying displacement is effected (arrows 8) by pneumatic means which fluidizes the material in the peripheral trough 4. As is apparent from FIG. 1, the base of the peripheral trough 4 is formed by a series of steps on which the material is propelled little by little under the action of a gas allowed to enter via inlets 9 topped by a deflector element 10. The propulsion system will be described later, with reference to FIGS. 6 and 7.

Figure 2:
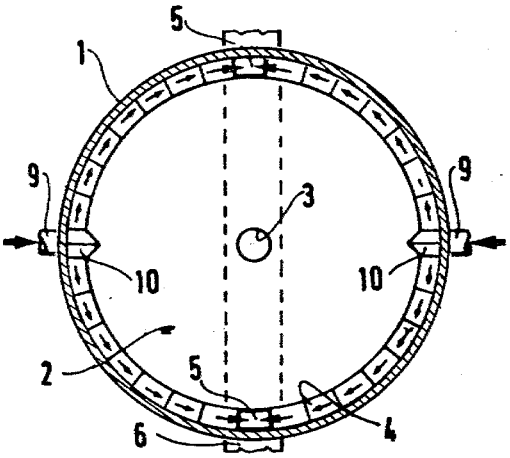
FIG. 2 is a view from above of the base of the silo of FIG. 1.

As shown in FIG. 2, the conveying action starts from each of the inlets 9 and proceeds in two adjacent series of steps, opposed in direction and separated by a deflector element 10, towards a discharge opening 5. The conveyor 6 can receive a central discharge (via the opening 3) and lateral discharge (via the openings 5).

It is possible to use many different arrangements for this peripheral conveying technique. If the transverse size of the silo becomes substantial (for example 30 meters in diameter) it is preferred to use a greater number of gas inlets and thus smaller trajectories towards the discharge openings, since otherwise the pressure losses may become excessive.

Figure 3:
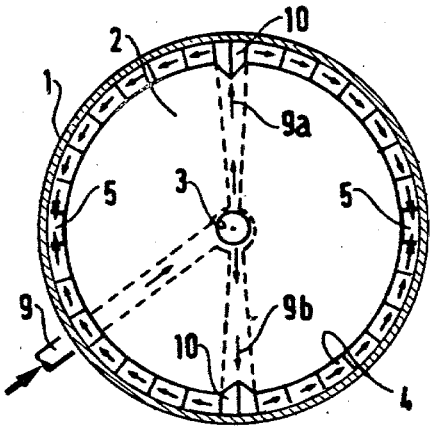
FIGS. 3 and 4 are views similar to FIG. 2 but showing modified arrangements.
Figure 4:
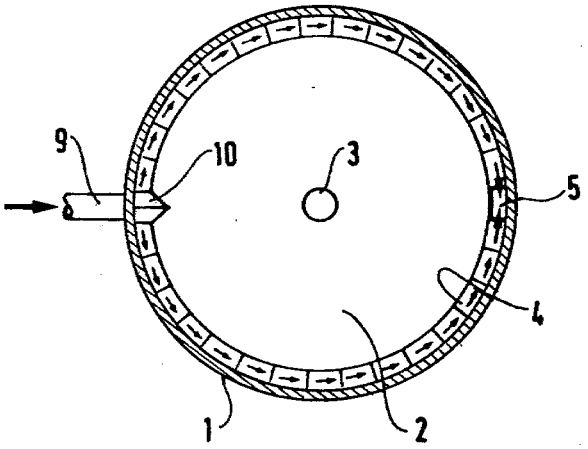

In the arrangement shown in FIG. 3, a central inlet 9 leads to two radial inlets 9*a*, 9*b*, the remainder being analogous to FIG. 2, whereas in the arrangement of FIG. 4 there is a single lateral inlet 9 and a single discharge opening 5, so that the peripheral paths correspond to half a circle in this case and not to a quarter of a circle.

Figure 5:
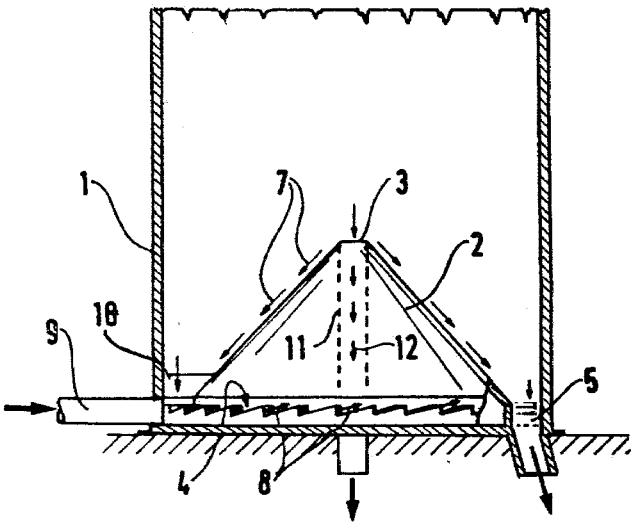
FIG. 5 is an axial cross-section corresponding to FIG. 4.

The cross-section of FIG. 5 illustrates the arrangement of FIG. 4: central gravitational discharge is provided by means of a pipe 11 (substantially vertical in this case) connecting the opening 3 to a bottom conveyor to provide a flow as indicated by arrows 12, the residue of the material being guided towards the peripheral trough 4 to be thereafter discharged through the sole discharge opening 5. It may prove to be advantageous to activate the pneumatic means at the same time as the central gravitational discharge, to reduce the volume of material tending to form a funnel above the opening 3.

Figure 6:
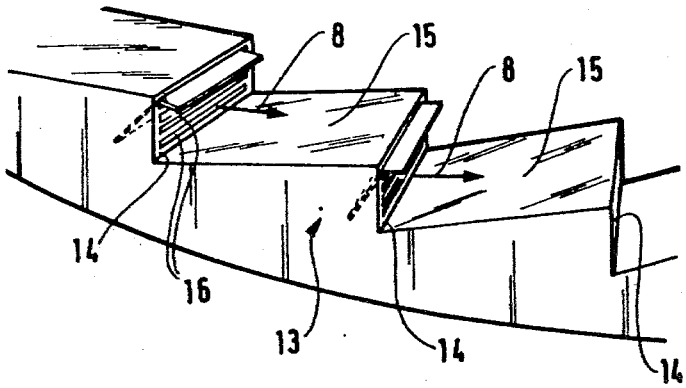
FIGS. 6 and 7 are respectively, a perspective and a vertical cross-section, of an annular blower duct whose upper stepped surface forms the bottom of the peripheral trough of the silo, the duct being equipped with an automatic control system.
Figure 7:
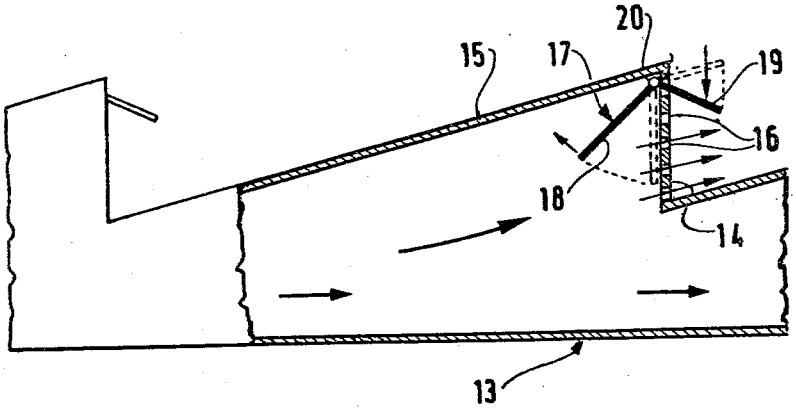

In FIGS. 6 and 7, the base of the stepped peripheral trough forms the upper surface of an annular blower duct. Each step has a substantially vertical surface 14 and a sloping surface 15 joining the top edge of the vertical surface to the bottom edge of the vertical surface of the preceding step. The pneumatic means for conveying the material along the trough comprises slots 16 formed in the vertical surfaces of the steps for blowing and propelling the material towards the discharge opening. The propulsion is thus arranged in sequence, from step to step, according to the arrows 8.

An automatic control system is incorporated in the form of a flap 17 formed by two plates 18, 19 arranged in V-shaped formation with a general horizontal apex 20, the outer plate 19 being exposed to the pressure exerted by the adjacent material, the inner plate 18 being arranged to shut off at least one blower slot 16, which is horizontal. This system operates as follows. When a substantial weight of material is on top of the steps, the weight of material on the flap 17 holds the flap in a position in which all the blower slots 16 are uncovered. When the weight falls below a particular threshold value at which the force exerted is insufficient to hold the flap in the open position, the flap swings to close the slots 16 (position illustrated by broken lines in FIG. 7), so that the speed of the air flowing through the uncovered slots then becomes substantially higher, which provides a complementary improvement of the conveying and final discharge of the material.

Here again, it is possible to make numerous modifications to this stepped duct, in particular as a function of the dimensions of the silo (in particular because of the pressure losses) and of storage requirements. Two examples of such modifications have been illustrated in FIGS. 8*a* and 8*b*.

Figure 8A:
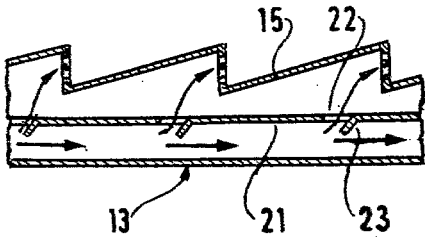
FIGS. 8*a* and 8*b* are modifications of the arrangement shown in FIG. 7 which permit the pressure losses within the duct to be reduced.
Figure 8B:
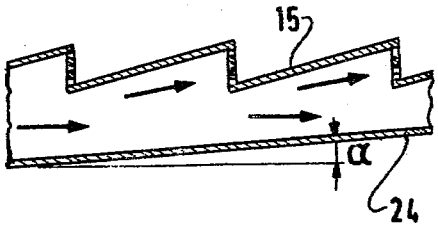

In FIG. 8*a*, the duct 13 has an intermediate partition 21 equipped with calibrated orifices 22, possibly comprising deflector shutters 23. The lower portion of the duct will thus channel the blowing gas more satisfactorily in the case of large silos and the pressure losses will be reduced significantly. In FIG. 8*b*, the duct 13 has a base 24 which is inclined (angle alpha) in such manner that the cross-section of the duct diminishes in the direction of flow of the gas and of movement of the material.

It is possible to make the upper and lower edges of the vertical surfaces parts of two slightly sloping planes, the discharge opening then being formed in the highest section of the base of the trough.

Figure 9:
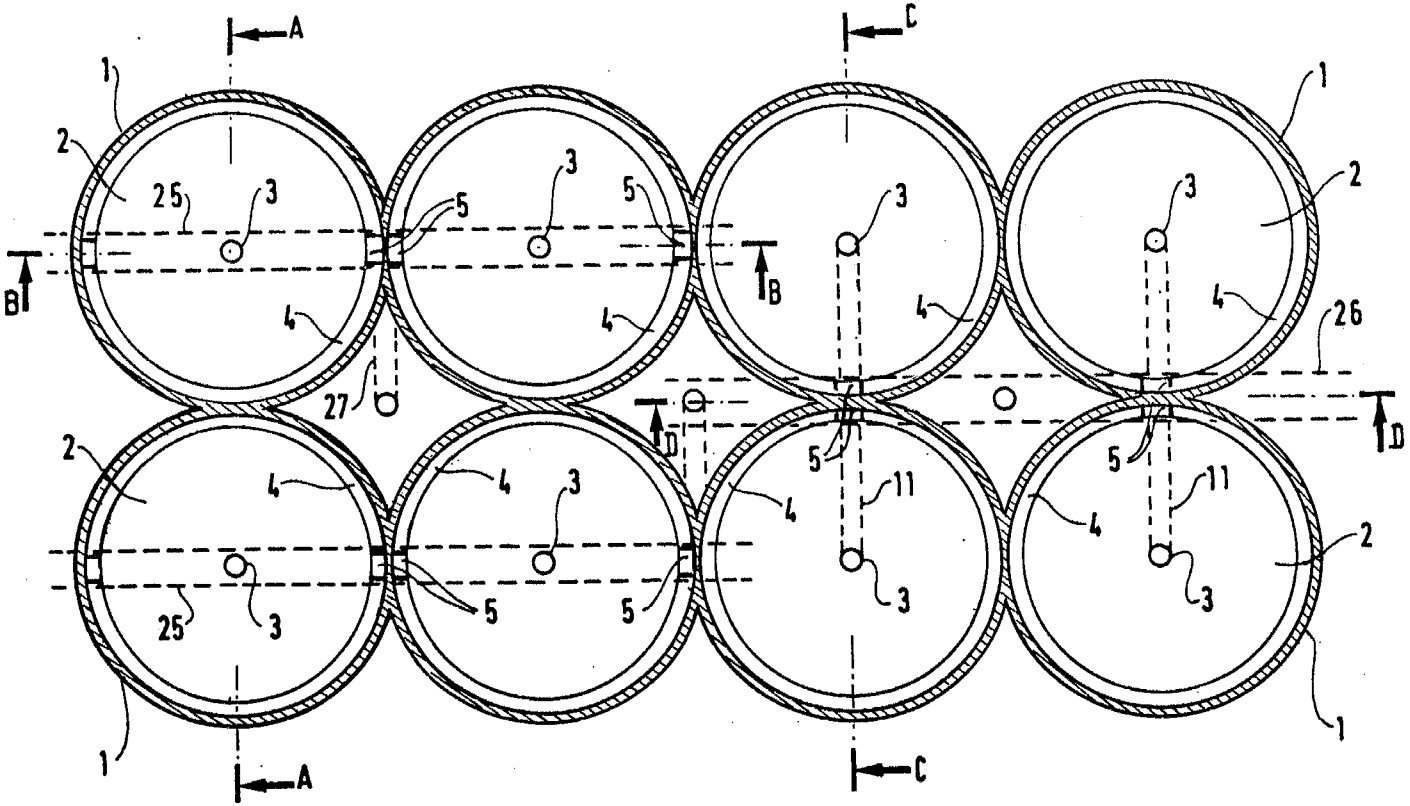
FIG. 9 is a horizontal cross-section through a group of mutually adjacent cylindrical silos.

FIG. 9 shows a group of juxtaposed cylindrical silos constructed in accordance with the preceding Figures. It is advantageous for two adjacent silos to have facing discharge opening 5, so that they may be connected to the same bottom conveyor.

Figure 10B:
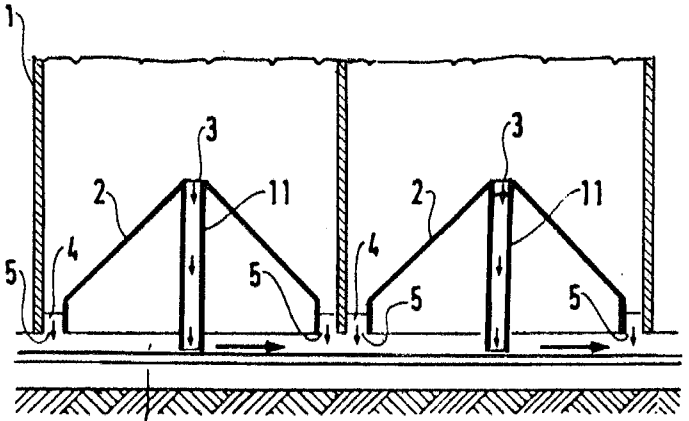
FIGS. 10*a*, 10*b*, 10*c* and 10*d* are vertical cross-sections along lines A—A, B—B, C—C and D—D, respectively of FIG. 9.
Figure 10D:
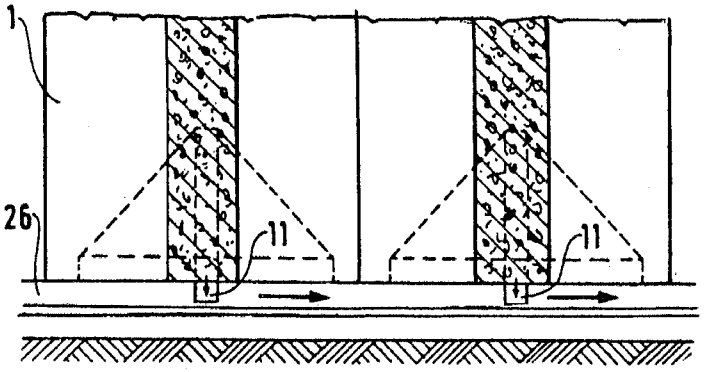
Figure 10A:
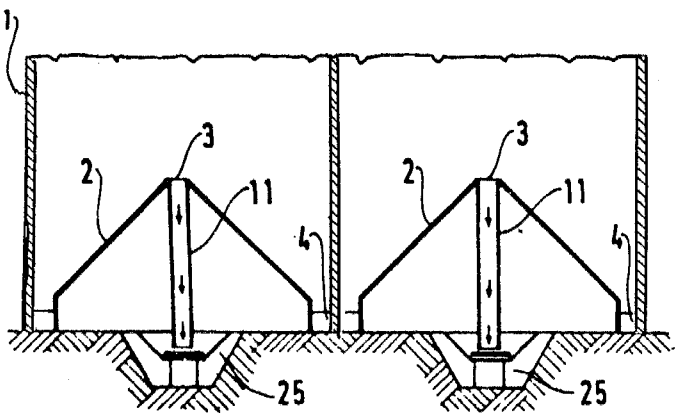
Figure 10C:
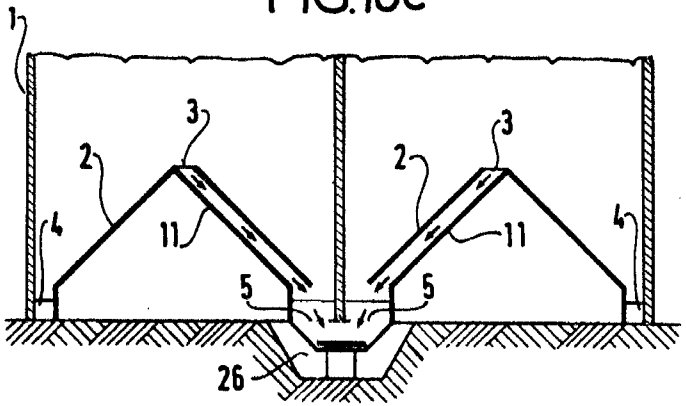

An arrangement having two lateral extraction tunnels 25 situated below the openings 3 and the openings 5 in which a conveyor is situated, is illustrated in the left-hand part of FIG. 9 and the corresponding cross-sections of FIGS. 10*a* and 10*b*. An arrangement comprising a central extraction tunnel 26 is illustrated in the right-hand part of FIG. 9 and the corresponding cross-sections of 10*c* and 10*d*; the central discharge pipes 11 slope towards the discharge opening 5. The pipes, such as 27, which are illustrated in FIG. 9, serve to drain the zone defined between four adjacent silos.

Figure 11:
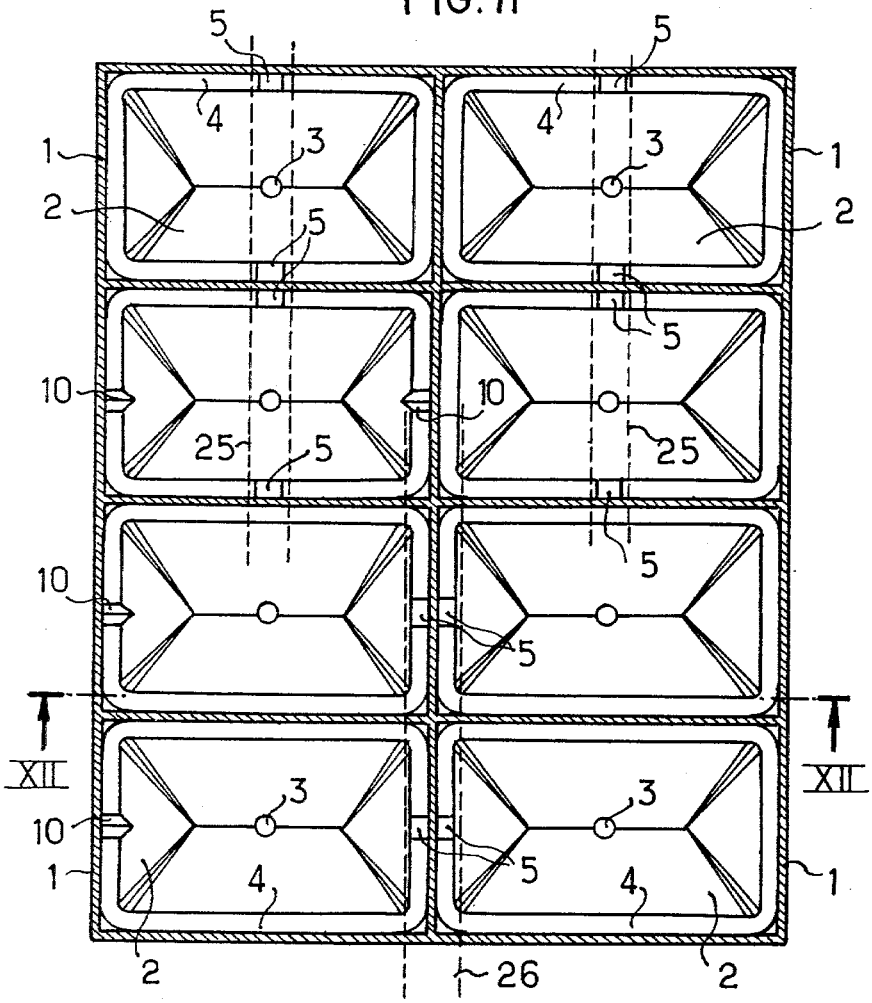
FIG. 11 is a horizontal cross-section through a group of juxtaposed rectangular silos.
Figure 12:
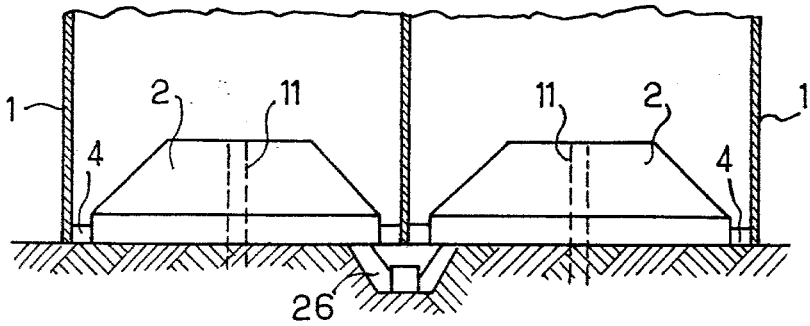
FIG. 12 is a cross-section along line X11—X11 of FIG. 11.

A group of silos comprising individual rectangular silos is illustrated in FIGS. 11 and 12. In this arrangement, the guiding surface 2 of each silo is formed by four sloping planes with the remainder of the silo being based on the same principle as for the circular silos. The extraction tunnels are either central (26, top part of FIG. 11) and/or lateral (25, bottom part of FIG. 11).

The silos particularly described are especially advantageous in that total draining of the silo can be achieved without the need for any manual intervention for the purpose of sweeping out residual material.

The invention is applicable to many different kinds of silo for industrial and/or agricultural use, even silos having a substantial transverse dimension, for example of 25 to 30 meters in the case of a cylindrical silo.

The stepwise pneumatic propulsion system of the material as illustrated in FIGS. 6, 7, 8*a*, 8*b* may be considered to be an "aeroescalator".

Although throughout the specification and claims each individual storage unit has been termed as a "silo" each individual unit may alternatively be considered to be a "silo element" particularly when several such elements are to be grouped together (for example as in FIGS. 9 to 12) wherein the overall group can be considered to constitute a "silo".

What is claimed is:

1. A silo for storing granular material comprising:

a receptacle surrounding a space with at least one vertical wall terminating in a continuous periphery at its bottom;

a static structure received in said space and diverging downwardly toward said bottom to form with said wall a peripheral trough extending around said space and said structure;

means defining at least one downwardly open discharge passage in said trough; and pneumatic means spaced along said trough for training jets of air at spaced locations around said periphery in the direction of said passage, thereby directing granular material flowing into said trough along said static structure in a peripheral motion toward said passage.

2. A silo for storing granular material comprising:

a receptacle surrounding a space with at least one vertical wall terminating in a continuous periphery at its bottom;

a static structure received in said space and diverging downwardly toward said bottom to form with said wall a peripheral trough extending around said space and said structure;

means defining at least one downwardly open discharge passage in said trough; and pneumatic means spaced along said trough for training jets of air at spaced locations around said periphery in the direction of said passage, thereby directing granular material flowing into said trough along said static structure in a peripheral motion toward said passage, said trough being formed with a series of steps each having a substantially vertical surface turned toward said passage, and a sloping surface connecting the top of each vertical surface with the bottom of the next vertical surface, said pneumatic means including slots formed in each vertical surface and emitting said jets of air, and means for supplying air to said slots.

3. The silo defined in claim 2 wherein two sets of steps are provided in said trough with respective vertical surfaces oriented in opposite senses but toward said passage from opposite sides thereof, said silo further comprising a deflector element along said periphery for directing granular material toward sets of steps with their vertical surfaces oriented in opposite senses.

4. The silo defined in claim 3 wherein a single discharge passage is provided diametrically opposite a single deflector, said sets of steps being disposed symmetrically on opposite sides of said space between said deflector and said passage.

5. The silo defined in claim 2, further comprising an annular tunnel extending along said trough and communicating with said slots.

6. The silo defined in claim 2 wherein upper and lower edges of said vertical surfaces lie in two substantially horizontal parallel planes.

7. The silo defined in claim 2 wherein the upper and lower edges of the vertical surfaces lie in two mutually parallel inclined planes and said discharge passage is located at an upper section of said trough.

8. The silo defined in claim 2 wherein said slots are substantially horizontal.

9. The silo defined in claim 1, further comprising a V-shaped control flap associated with at least one step, said flap comprising two mutually inclined plates with a substantially horizontal apex, one of the plates being external with respect to the vertical surface of said step and being exposed to the pressure exerted by the adjacent material, and the other plate being situated internally of the step behind said surface and being arranged to selectively shut off at least one slot.

10. The silo defined in claim 2, further comprising a conveyor extending beneath said space, said passage opening downwardly onto said conveyor, said structure having an outlet opening at its apex and emptying into said conveyor.

11. The silo defined in claim 10 wherein said pipe is inclined and said passage opens into said pipe.

12. The silo defined in claim 2 which is disposed adjacent a further silo, the passages of the two silos being disposed opposite one another, said passages opening onto a common conveyor disposed below said silos.

* * * * *